United States Patent [19]

Givati et al.

[11] Patent Number: 4,790,680

[45] Date of Patent: Dec. 13, 1988

[54] FASTENER STRUCTURE FOR FILES AND MULTI-PURPOSE CLIP FOR USE THEREWITH

[75] Inventors: Izhak Givati; Ehud Baruch, both of Tel-Aviv, Israel

[73] Assignee: Shakbar Investments Ltd., Tel Aviv, Israel

[21] Appl. No.: 136,667

[22] Filed: Dec. 22, 1987

[30] Foreign Application Priority Data

Jan. 14, 1987 [IL] Israel ..... 81263

[51] Int. Cl.[4] ..... B42F 13/36; B42F 13/00; B42F 3/00; B42F 1/02

[52] U.S. Cl. ..... 402/68; 402/74; 402/500; 24/67.9

[58] Field of Search ..... 402/25, 59, 60, 61, 402/62, 68, 500, 74; 24/67 PR, 67.9, 467, 458, 47, 453; 281/29; 428/98, 221

[56] References Cited

U.S. PATENT DOCUMENTS

| | | | |
|---|---|---|---|
| 359,324 | 3/1887 | McGill | 24/67 R |
| 785,911 | 3/1905 | Nold | 402/68 |
| 819,504 | 5/1906 | Benedict | 24/67.9 |
| 1,648,408 | 11/1927 | Kumagai | 24/67.9 |
| 1,744,560 | 1/1930 | Lukacs | 24/67.9 |
| 2,808,871 | 10/1957 | Brown | 402/500 |
| 2,938,252 | 5/1960 | Scheemaeker | 24/67.9 |
| 3,057,028 | 10/1962 | Lorber | 24/67.9 |

FOREIGN PATENT DOCUMENTS

| | | | |
|---|---|---|---|
| 103261 | 1/1917 | United Kingdom | 402/74 |

*Primary Examiner*—Frank T. Yost
*Assistant Examiner*—Paul M. Heyrana
*Attorney, Agent, or Firm*—Benjamin J. Barish

[57] ABSTRACT

A multi-purpose clip for clipping papers and also useful in a fastener structure for a paper file, comprises an elongated member formed with a pair of longitudinally-spaced holes adjacent to one edge to receive the fastening elements of the paper file. The elongated member is further formed with a slot extending from each of the holes to the opposite edge of the elongated member such that the slots permit the elongated member to be removed from the fastening elements by moving the elongated member laterally in the direction of the opposite edge. The slots also define a center jaw and a pair of end jaws for clamping together the papers overlying the place in the file where one or more papers are to be added or removed.

13 Claims, 2 Drawing Sheets

FIG.1
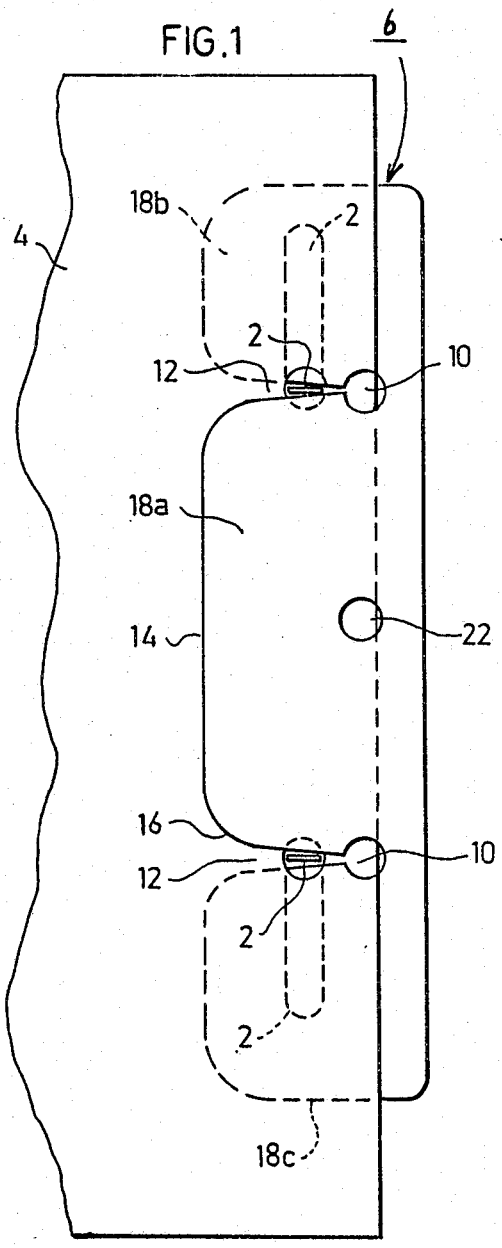
FIG 2
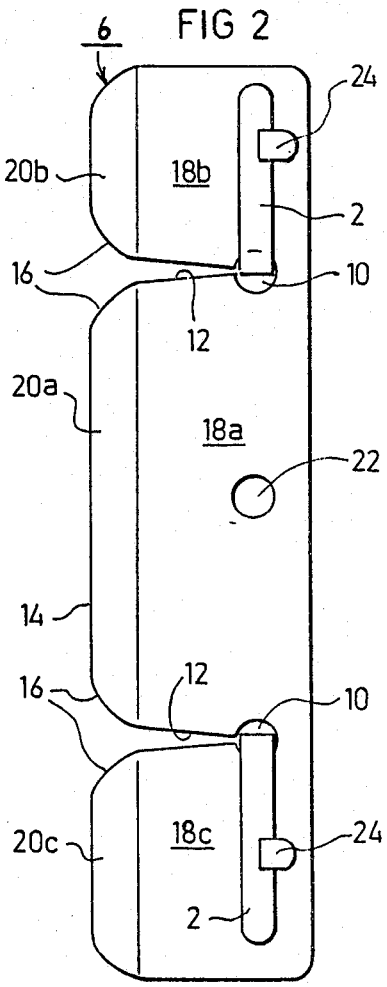
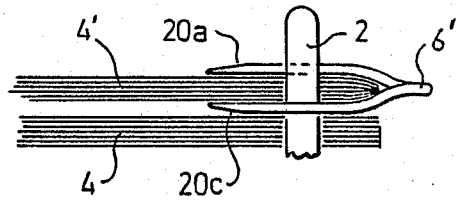
FIG 3

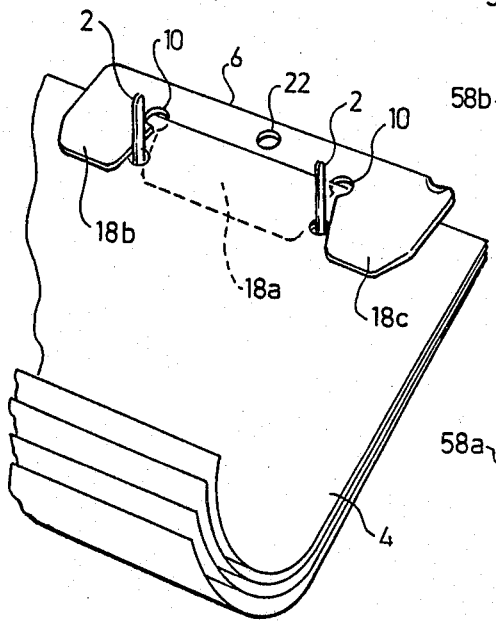
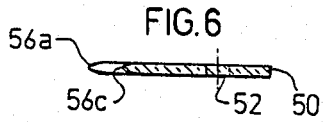
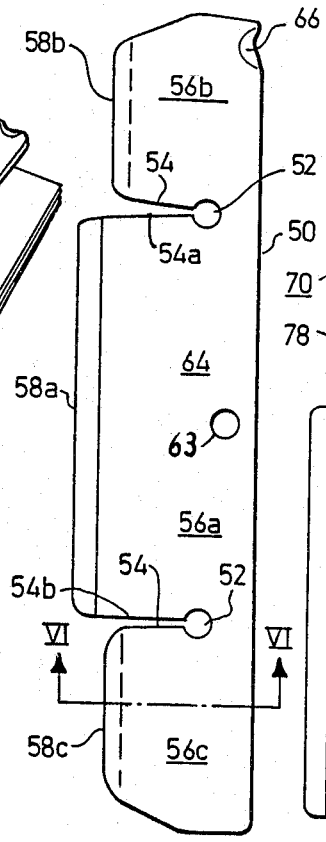
FIG 5
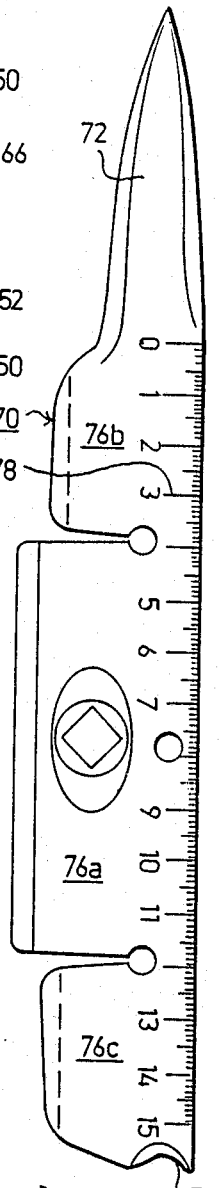
FIG 8
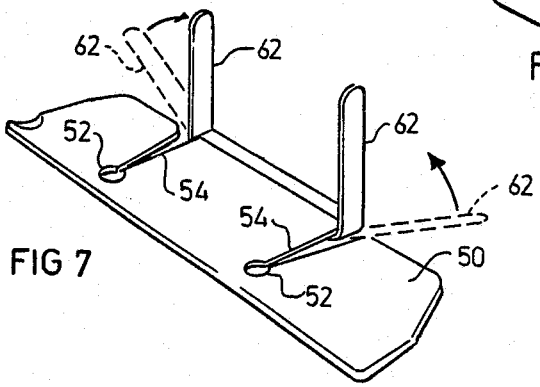
FIG 7

FASTENER STRUCTURE FOR FILES AND MULTI-PURPOSE CLIP FOR USE THEREWITH

BACKGROUND OF THE INVENTION

The present invention relates to a fastener structure, and particularly to a fastener structure for a type of paper file now commonly used in offices. The invention also relates to a multi-purpose file clip for use with the fastener structure of the foregoing type.

The paper file to which the present invention is particularly applicable is the type which includes a pair of bendable fastening elements or tongues receivable in holes formed adjacent to one edge of the papers fastened in the file, and an elongated member overlying the fastened papers and formed with a pair of holes receiving the fastening elements for securing the papers in the file. In this type of file, the elongated member is removable from the fastening elements to permit removal of papers from the file, or the addition of papers to the file.

When one or more papers are to be removed from or added to a middle part of the file, the elongated member togther with the overlying papers are removed from the file. However, it frequently happens that the overlying papers move relative to each other so that their holes are no longer in alignment with the fastening elements. When this occurs, it is usually necessary to return the overlying papers to the file one at a time, which is a time-consuming process.

BRIEF SUMMARY OF THE INVENTION

An object of the present invention is to provide a fastener structure or multi-purpose clip for a paper file which more conveniently permits removing or adding one or more papers with respect to a middle part of a stack of papers in a file of this type.

According to the present invention, there is provided a multi-purpose clip for clipping papers and also useful in a fastener structure for a paper file, comprising: an elongated member formed with a pair of longitudinally-spaced holes adjacent to one edge dimensioned to receive the fastening elements of the paper file; the elongated member being further formed with a slot extending from each of the holes to the opposite edge of the elongated member such that the slots permit the elongated member to be removed from the fastening elements by moving the elongated member laterally in the direction of said opposite edge, the slots defining a center jaw and a pair of end jaws for clamping together the papers overlying the place in the file where one or more papers are to be added or removed.

As will be described below, such a clip permits the removal or addition of papers with respect to a middle part of the file in a very convenient manner. In addition, the elongated element is preferably made of stiff plastics material, which enables it to serve also as a clip for many other purposes, e.g., for serving as a marker in a file.

Fastener structures and multi-purpose clips constructed in accordance with the above features may be manufactured in volume and at low cost.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of fastener structure constructed in accordance with the present invention for fastening papers to a file;

FIG. 2 illustrates only the elongated member, or paper clip, in the fastener structure of FIG. 1;

FIG. 3 is an end view illustrating the elongated member being used to clamp a plurality of papers together in order to permit the addition or removal of one or more papers from a middle portion of the file in a convenient manner;

FIG. 4 illustrates the manner of using the elongated member or paper clip to add or remove papers from a file;

FIG. 5 is a view similar to that of FIG. 2 but illustrating a modification in the construction of the elongated member or paper clip;

FIG. 6 is a sectional view of the member of FIG. 5 along line VI—VI;

FIG. 7 illustrates the use of the member of FIG. 5 for initially bending the tongues in the file; and FIG. 8 illustrates a further construction in the elongated member or paper clip.

DESCRIPTION OF PREFERRED EMBODIMENTS

The fastener structure illustrated in FIGS. 1–3 of the drawings is intended for use with a type of file including a pair of fastening elements 2 in the form of tongues which are bendable to secure the papers 4 and an elongated member 6 together in the file. The papers 4 and elongated member 6 are formed with a pair of holes 10 for receiving the bendable fastening tongues 2.

In some of the known constructions of such fasteners, the tongues are secured to the inside face of the file cover, and the elongated member 6 is merely a strip of cardboard or plastic sheet material applied over the papers fastened in the file; in other constructions, the elongated member is of metal or other stiff material and includes slidable locking elements for locking the tongues in their bent condition.

In the fastener structure illustrated in FIGS. 1–3, the elongated member 6 is formed with a slot 12 extending from each of its holes 10 to the outer edge 14 of the elongated member facing the inner edges of the sheets 4 fastened in the file. Each of the slots 12 is of increasing width from its respective hole 10 to the outer edge 14, and the outer edges are rounded as shown at 16.

Slots 12 thus permit the elongated member 6 to be removed from the fastening tongues 2 by moving the elongated member laterally (rightwardly, FIG. 1) until the slots 12 clear the fastening tongues 2. The slots 12 also divide the portion of the elongated member between its holes 10 and its edge 14 into a center jaw **18*a* and a pair of end jaws 18*b*, 18*c* on opposite sides of the central jaw 18*a*. The outer margin of the central jaw 18*a* is tapered outwardly in one direction as shown at 20*a*, and the outer margins of the two end jaws 18*b*, 18*c* are likewise tapererd outwardly but in the opposite direction, as shown at 20*b*, 20*c***.

Elongated member 6 includes a further hole 22 midway between the two holes 10 for supporting a plurality of clamped papers in suspension. It further includes a pair of lugs 24 for retaining the tongues 2 in their bent condition.

The fastener structure illustrated in FIGS. 1–3 is used in the following manner as shown particularly in FIG. 4.

The paper sheets 4 in the file are securely clamped therein by passing tongues 2 through the holes in the paper sheets, and through holes 10 in the elongated member 6, and then bending the tongues 2 as shown in dotted lines in FIG. 1. Now, whenever it is desired to break the file by adding one or more paper sheets to a middle part of the file, or by removing one or more paper sheets from a middle part of the file, the paper sheets overlying the point where the papers are to be removed or added are gripped by the user, the gripped papers being shown at 4' in FIG. 3; and the elongated member 6 is then moved laterally (upwardly in FIG. 4) such that the fastening tongues 2 pass out of the holes 10 in the elongated member and through the slots 12 until the outer edge 14 of the elongated member clears the tongues. While the overlying papers 4' are still gripped, the user then passes the overlying gripped papers 4' between the central jaw 18*a* and the outer jaws 18*b*, 18*c*, as shown in FIGS. 3 and 4, and slides the elongated member 6 back onto the gripped sheets 4' with the tongues 2 again passing along slots 12 into the holes 10. The elongated member 6, together with the sheets 4' clamped between its jaws 18*a*, 18*b*, 18*c*, is then lifted off the tongues 2.

The paper sheets to be added to the stack are then applied over tongues 2, or if paper sheets are to be removed, they are then removed from the tongues 2. The elongated member 6 together with the sheets 4' clamped between its jaws 18*a*, 18*b*, 18*c*, is then reapplied over tongues 2; elongated member 6 is then moved rightwardly (FIG. 3) until its jaws clear the ends of the paper sheets 4'; the elongated member is slid over the upper sheet; and the tongues 2 are then bent down so that the file is now in its original fastened condition.

It will thus be seen that the use of the elongated member 6, for clipping together the upper sheets 4' to be temporarily removed from the file, permits the file to be broken for the removal of sheets from the middle of the file or for the addition of sheets to the middle of the file, in a very convenient manner. The elongated member 6 also may be used for clipping together a plurality of papers for other purposes, for example to serve as a file marker, in order to mark certain papers or groups of papers in the file for ready access. The elongated member may have a writable surface, to permit writing various notes when the member is used as a file marker.

Central hole 22 is provided to permit the elongated member 6 to be used for supporting in suspension a plurality of sheets clamped between its jaws 18*a*, 18*b*, 18*c*.

FIGS. 5, 6 and 7 illustrate a slightly different construction in the elongated member or plastic clip, therein designated 50. This member is also formed with a pair of holes 52 and connecting slots 54 dividing one side into a center jaw 56*a* and two end jaws 56*b*, 56*c*. In this case, however, the center jaw 56*a* is extended past the end jaws 56*b*, 56*c*; in addition, the slots 54 on the opposite sides of the center jaw 56*a* define straight edges 54*a*, 54*b* substantially at right angles to the outer edge of the jaw. This is to permit the plastic member 50 also to be used for initially bending the tongues 62 at the correct locations when opening a new file, as shown in FIG. 7.

The outer edges of the three jaws 56*a*, 56*b*, 56*c* are tapered on their opposite sides to facilitate sliding the plastic member onto the paper sheets to be clipped. In addition, the plastic member 50 is formed with a central opening 63 to enable it to be used for holding in suspension a plurality of sheets clipped together between the jaws 56*a*, 56*b*, 56*c*.

Plastic member 50 may thus be used not only for fastening sheets together in a file as described above, but also as a general-purpose paper clip for clipping together a plurality of papers, e.g., as a marker for selected papers or groups of papers in a file. This member may also be used for other purposes. Thus, as shown in FIG. 5, one side of plastic member 50, shown at 64, may include a pattern for printing alphanumerical characters, and one end may be formed as a finger nail cleaner as shown at 66.

FIG. 8 illustrates a plastic member, therein designated 70, constructed so as to provide all the foregoing uses, as well as additional uses. Member 70 is basically of the same construction as illustrated in FIG. 5, but with one end extended and pointed to serve as a letter opener 72, the opposite end being formed as a finger nail cleaner 74. In addition, the edge of plastic member 70 opposite to that formed with the middle jaw 76 and end jaws 76*b*, 76*c*, is formed as a straight edge and includes rule markings 78, enabling the plastic member also to be used as a straight edge and ruler. Plastic member 70 may also carry advertising matter.

It will be appreciated that the described clip could be formed with more than two openings and slots to adapt it for files of different sizes. Also, the described clip can be used in other applications, e.g., as a bag clip, assembly toy, or the like. Many other variations and applications of the invention will be apparent.

What is claimed is:

1. A multi-purpose clip for clipping papers and also useful in a fastener structure for a paper file, comprising: an elongated member formed with a pair of longitudinally-spaced holes adjacent to one edge dimensioned to receive the fastening elements of the paper file; said elongated member being further formed with a slot extending from each of said holes to the opposite edge of the elongated member such that said slots permit the elongated member to be removed from the fastening elements by moving the elongated member laterally in the direction of said opposite edge, said slots defining a center jaw and a pair of end jaws for clamping together the papers overlying the place in the file where one or more papers are to be added or removed.

2. The clip according to claim 1, wherein said center jaw is extended to project past said end jaws and is formed with straight sides to enable the use of said straight sides for initially bending fastening tongues of the paper file at predetermined points when opening a new file.

3. The clip according to claim 1, wherein the outer edges of the center and end jaws are tapered to facilitate slipping the jaws onto the overlying papers.

4. The clip according to claim 1, wherein the outer edges of said jaws are rounded.

5. The clip according to claim 1, wherein said elongated member is of stiff plastics material.

6. A multi-purpose clip for clipping papers and also useful in a fastener structure for a paper file, comprising: an elongated member of stiff plastics material formed with a pair of longitudinally-spaced holes adjacent to the edge to receive the fastening elements of the paper file; said elongated member being further formed with a slot extending from each of said holes to the opposite edge of the elongated member defining a center jaw and a pair of end jaws for clamping papers together.

7. The clip according to claim 6, wherein said center jaw is extended to project past said end jaws and is formed with straight sides to enable the use of said straight sides for initially bending fastening tongues of the paper file at predetermined points when opening a new file.

8. The plastic clip according to claim 6, wherein the outer edges of the center and end jaws are tapered to facilitate slipping the jaws onto the overlying papers.

9. The clip according to claim 6, wherein the outer edges of said jaws are rounded.

10. A multi-purpose clip for clipping papers and also useful in a fastener structure for a paper file, comprising: an elongated member formed with a pair of longitudinally-spaced holes adjacent to one edge dimensioned to receive the fastening elements of the paper file; said elongated member being further formed with a slot extending from each of said holes to the opposite edge of the elongated member such that said slots permit the elongated member to be removed from the fastening elements by moving the elongated member laterally in the direction of said opposite edge, said slots defining a center jaw and a pair of end jaws for clamping together the papers overlying the place in the file where one or more papers are to be added or removed; said center jaw being extended to project past said end jaws and being formed with straight sides to enable the use of said straight sides for initially bending fastening tongues of the paper file at predetermined points when opening a new file.

11. The plastic clip according to claim 10, wherein the outer edges of the center and end jaws are tapered to facilitate slipping the jaws onto the overlying papers.

12. The clip according to claim 10, wherein the outer edges of said jaws are rounded.

13. The clip according to claim 10, wherein said elongated member is of stiff plastics material.

* * * * *